US012466675B2

(12) United States Patent
Ishioka

(10) Patent No.: US 12,466,675 B2
(45) Date of Patent: Nov. 11, 2025

(54) IMAGE FORMING APPARATUS

(71) Applicant: CANON KABUSHIKI KAISHA, Tokyo (JP)

(72) Inventor: Naoki Ishioka, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 65 days.

(21) Appl. No.: 17/879,084

(22) Filed: Aug. 2, 2022

(65) Prior Publication Data

US 2023/0055294 A1 Feb. 23, 2023

(30) Foreign Application Priority Data

Aug. 19, 2021 (JP) ..... 2021-134084

(51) Int. Cl.
*B65H 5/36* (2006.01)
*B65H 5/06* (2006.01)

(52) U.S. Cl.
CPC ..... *B65H 5/062* (2013.01); *B65H 5/36* (2013.01); *B65H 2403/51* (2013.01)

(58) Field of Classification Search
CPC ..... B65H 5/062; B65H 5/36; B65H 2403/51
See application file for complete search history.

(56) References Cited

U.S. PATENT DOCUMENTS 5,534,989 A * 7/1996 Rubscha ..... H04N 1/00572 271/3.14
9,908,727 B2 3/2018 Kaisha
2015/0246555 A1* 9/2015 Kamitani ..... B41J 2/325 347/215
2018/0362283 A1* 12/2018 Yamamoto ..... B65H 5/36
2020/0183311 A1* 6/2020 Sakurai ..... G03G 15/6579

FOREIGN PATENT DOCUMENTS

| | | | |
|---|---|---|---|
| JP | H07315622 | A | 12/1995 |
| JP | 2004269108 | A | 9/2004 |
| JP | 2007276951 | A | 10/2007 |
| JP | 2011-235994 | * | 11/2011 |
| JP | 2013148740 | A | 8/2013 |
| JP | 2017024886 | A | 2/2017 |
| JP | 2020111413 | A | 7/2020 |

OTHER PUBLICATIONS

Machine translation of JP 2011-235994. (Year: 2011).*

* cited by examiner

*Primary Examiner* — Thomas A Morrison
(74) *Attorney, Agent, or Firm* — ROSSI, KIMMS & McDOWELL LLP

(57) ABSTRACT

An image forming apparatus includes an image forming portion, a first conveyance path, a second conveyance path, a curved conveyance path, a first roller pair, a second roller pair disposed along the curved conveyance path, an inner guide, and an outer guide opposing the inner guide, constituting at least part of the curved conveyance path between the first roller pair and the second roller pair together with the inner guide, and provided on an outer side in a curving direction of the curved conveyance path. A nip line of the first roller pair and a nip line of the second roller pair intersect with each other. The outer guide is movable between a first position and a second position that is farther away from the inner guide than the first position.

10 Claims, 10 Drawing Sheets

IMAGE FORMING APPARATUS

BACKGROUND OF THE INVENTION

Field of the Invention

The present invention relates to an image forming apparatus that forms an image on a sheet.

Description of the Related Art

Conventionally, an image forming apparatus capable of switching a loop roller and a plurality of intermediate conveyance rollers between a pressure contact state and a separation state is proposed in Japanese Patent Laid-Open No. 2013-148740. In a conveyance path where the plurality of intermediate conveyance rollers are provided, a guide plate capable of retracting from a normal position to a retracting position is provided. By retracting the guide plate to the retracting position, a frictional resistance applied to the sheet passing through a bent conveyance path can be reduced.

When a sheet passes through a bent conveyance path, the conveyance resistance increases due to the stiffness of the sheet. In addition, in the case where a conveyance roller pair is provided along the bent conveyance path, the conveyance load on the conveyance roller pair increases due to the conveyance resistance of the sheet, and there is a possibility that a jam occurs.

SUMMARY OF THE INVENTION

According to an aspect of the present invention, an image forming apparatus includes an image forming portion configured to form an image on a sheet, a first conveyance path through which the sheet is conveyed toward the image forming portion, a second conveyance path through which the sheet on a first surface of which an image has been formed by the image forming portion is conveyed again toward the first conveyance path so as to form an image on a second surface opposite to the first surface by the image forming portion, a curved conveyance path that is curved and configured to be continuous with the second conveyance path and merge with the first conveyance path, a first roller pair that is included in a plurality of conveyance roller pairs arranged along the second conveyance path, positioned most downstream among the plurality of conveyance roller pairs in a sheet conveyance direction, and configured to convey the sheet, a second roller pair disposed along the curved conveyance path and adjacent to the first roller pair in the sheet conveyance direction and configured to convey the sheet, an inner guide, and an outer guide opposing the inner guide, constituting at least part of the curved conveyance path between the first roller pair and the second roller pair together with the inner guide, and provided on an outer side in a curving direction of the curved conveyance path. A nip line of the first roller pair and a nip line of the second roller pair intersect with each other. The outer guide is movable between a first position and a second position that is farther away from the inner guide than the first position.

Further features of the present invention will become apparent from the following description of exemplary embodiments with reference to the attached drawings.

DESCRIPTION OF THE EMBODIMENTS

First Embodiment

Figure 1:
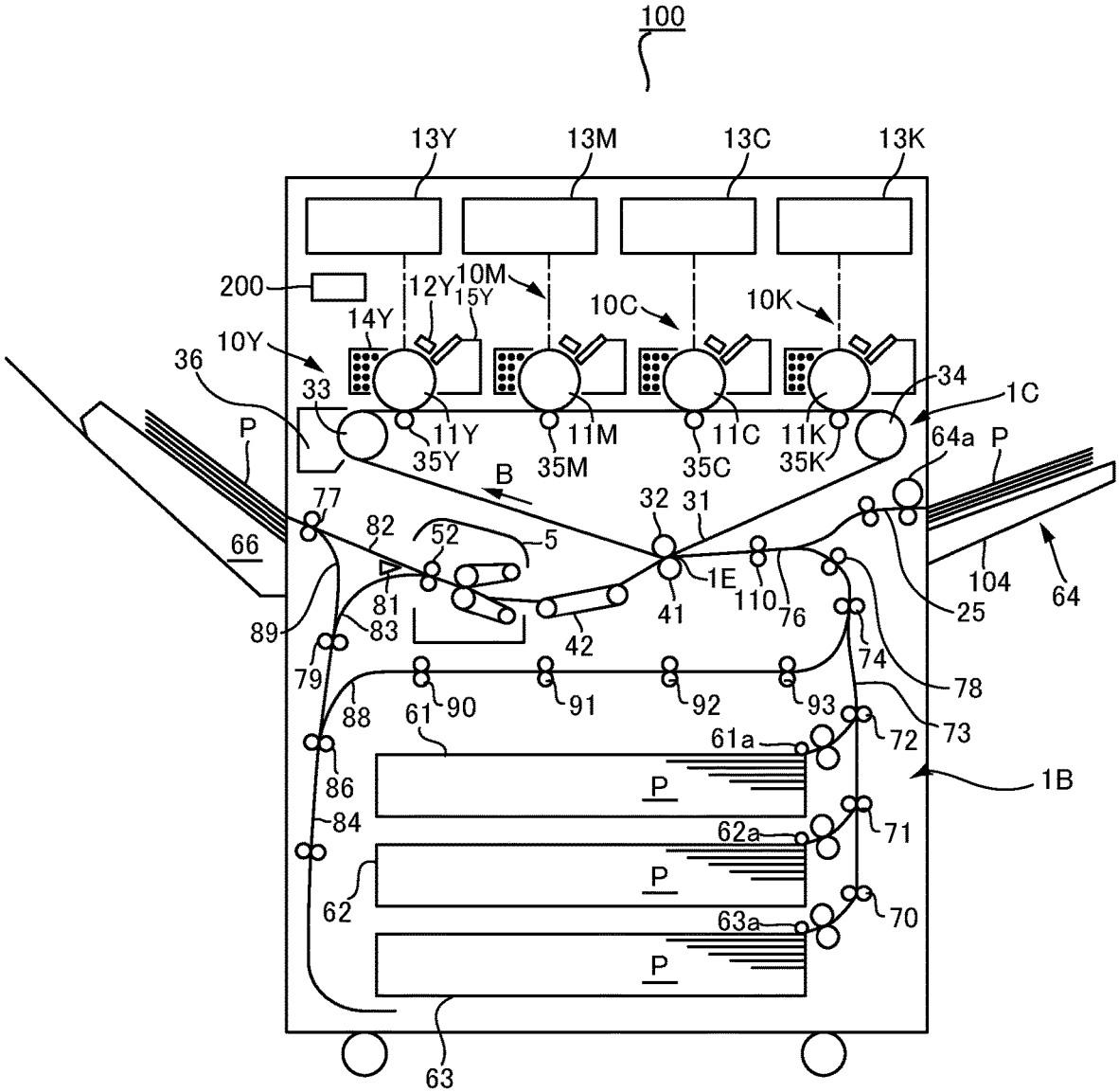
FIG. 1 is an overall schematic view of a printer according to a first embodiment.

First, a first embodiment of the present invention will be described. A printer 100 serving as an image forming apparatus according to a first embodiment is a laser beam printer of an electrophotographic system. As illustrated in FIG. 1, the printer 100 includes a cassette feed portion 1B, a manual feed portion 64, and an image forming unit 1C.

When a command for image formation is output to the printer 100, an image formation process by the image forming unit 1C is started on the basis of image information input from an external computer or the like connected to the printer 100. The image forming unit 1C includes four exposing units 13Y, 13M, 13C, and 13K, and four process cartridges 10Y, 10M, 10C, and 10K that respectively form images of four colors of yellow, magenta, cyan, and black. Letters Y, M, C, and K respectively correspond to yellow, magenta, cyan, and black. In addition, the image forming unit 1C includes an intermediate transfer belt 31 stretched over a driving roller 33, a tension roller 34, and a secondary transfer inner roller 32 and capable of rotating in an arrow B direction.

To be noted, the four process cartridges 10Y, 10M, 10C, and 10K have the same configuration except for the color of images formed thereby. Therefore, only an image formation process of the process cartridge 10Y will be described, and description of the process cartridges 10M, 10C, and 10K will be omitted.

The exposing unit 13Y radiates laser light toward a photosensitive drum 11Y of the process cartridge 10Y on the basis of the input image information. At this time, the photosensitive drum 11Y is charged by a charger 12Y in advance, and an electrostatic latent image is formed on the photosensitive drum 11Y by irradiating the photosensitive drum 11Y with laser light. Then, the electrostatic latent image is developed by a developing unit 14Y, and thus a yellow (Y) toner image is formed on the photosensitive drum 11Y. Toner remaining on the photosensitive drum 11Y after the toner image is transferred onto the intermediate transfer belt 31 is collected by a cleaner 15Y.

Similarly, magenta (M), cyan (C), and black (K) toner images are respectively formed on photosensitive drums of the process cartridges 10M, 10C, and 10K. The toner images of respective colors formed on the respective photosensitive drums are transferred onto the intermediate transfer belt 31 by primary transfer rollers 35Y, 35M, 35C, and 35K, and are conveyed to the secondary transfer inner roller 32 by rotation of the intermediate transfer belt 31. To be noted, the image formation process of each color is performed at such a timing that the toner image formed thereby is superimposed on an upstream toner image that has been already transferred onto the intermediate transfer belt 31 through primary transfer.

In parallel with the image formation process described above, a sheet P is fed from the cassette feed portion 1B or the manual feed portion 64. The cassette feed portion 1B includes a plurality of cassettes 61, 62, and 63, that is, three cassettes are provided in the present embodiment. The sheet P is fed from the cassettes 61, 62, and 63 respectively by pickup rollers 61*a*, 62*a*, and 63*a*. In addition, the manual feed portion 64 includes a manual feed tray 104 that is pivotably supported, and the sheet P supported on the manual feed tray 104 is fed by a pickup roller 64*a*.

The sheet P fed by the pickup roller 61*a*, 62*a*, 63*a*, or 64*a* is conveyed to a registration roller pair 110 by conveyance roller pairs 70 to 75 and a pre-registration roller pair 78. The pre-registration roller pair 78 conveys the sheet P toward a nip portion of the registration roller pair 110 that is not driving. As a result of this, the leading end of the sheet P can be caused to follow the nip portion, and thus the skew of the sheet P can be corrected.

Then, the sheet P is conveyed by the registration roller pair 110 at a predetermined timing, and a predetermined pressurizing force and an electrostatic bias are applied to the first surface of the sheet P in a transfer nip 1E formed by the secondary transfer inner roller 32 and a secondary transfer outer roller 41. As a result of this, the full-color toner image on the intermediate transfer belt 31 is transferred onto the first surface of the sheet P. Residual toner remaining on the intermediate transfer belt 31 is collected by a cleaner 36.

The sheet P on which the toner image has been transferred is conveyed to a fixing unit 5 by an air suction belt 42, and a predetermined pressurizing force and heat are applied thereto to melt and fix the toner image. The sheet P having passed through the fixing unit 5 is, by a fixing conveyance roller pair 52, conveyed to a discharge conveyance path 82 in the case of directly discharging the sheet P onto a discharge tray 66, and conveyed to an inversion guidance path 83 in the case of forming images on both surfaces of the sheet P.

At a branching portion between the discharge conveyance path 82 and the inversion guidance path 83, a guide member 81 is pivotably provided. The guide member 81 is provided for switching the path in accordance with a discharge job for discharging the sheet P onto the discharge tray 66, a reverse discharge job for reversing and discharging the sheet P, and a duplex conveyance job for conveying the sheet P to the image forming unit 1C again. Further, as a result of the switching of the path by the guide member 81, the sheet P is guided to the discharge conveyance path 82 or the inversion guidance path 83 in accordance with the set job.

For example, in the case of the discharge job, the guide member 81 pivots downward to a discharge position for discharging a sheet. As a result of this, the sheet P conveyed by the fixing conveyance roller pair 52 is conveyed to the discharge conveyance path 82 along an upper surface of the guide member 81, and is discharged onto the discharge tray 66 by the discharge roller pair 77.

In addition, in the case of the duplex conveyance job, the guide member 81 pivots upward to a pull-in position for guiding the sheet to the inversion guidance path 83. As a result of this, the sheet P conveyed by the fixing conveyance roller pair 52 is guided to the inversion guidance path 83 along a lower surface of the guide member 81, and pulled into a switchback path 84 by a first reverse conveyance roller pair 79. Then, by a switchback operation of reversing the rotation direction of a second reverse conveyance roller pair 86, the leading end and the trailing end and the front surface and the back surface of the sheet P are swapped, and then the sheet P is conveyed to the duplex conveyance path 88. Then, the sheet P conveyed to the duplex conveyance path 88 is conveyed to the transfer nip 1E serving as an image forming portion via a U-turn conveyance path 94 and a straight conveyance path 76.

To be noted, a plurality of conveyance roller pairs 90 to 93 that convey the sheet P are provided along the duplex conveyance path 88. In addition, the image formation process on the back surface serving as a second surface after this is substantially the same as the image formation process on the front surface serving as a first surface that has been already described, and therefore description thereof will be omitted.

In addition, also in the case of the reverse discharge job, the guide member 81 pivots upward to the pull-in position. As a result of this, the sheet P is conveyed to the inversion guidance path 83 by the fixing conveyance roller pair 52, and pulled into the switchback path 84 by the first reverse conveyance roller pair 79. Then, the leading end and trailing end of the sheet P are swapped by the switchback operation of reversing the rotation direction of the first reverse conveyance roller pair 79, and then the sheet P is conveyed to the reverse conveyance path 89. Then, the sheet P is conveyed to the discharge roller pair 77, and is discharged onto the discharge tray 66 by the discharge roller pair 77.

Peripheral Configuration of U-Turn Conveyance Path

Figure 2:
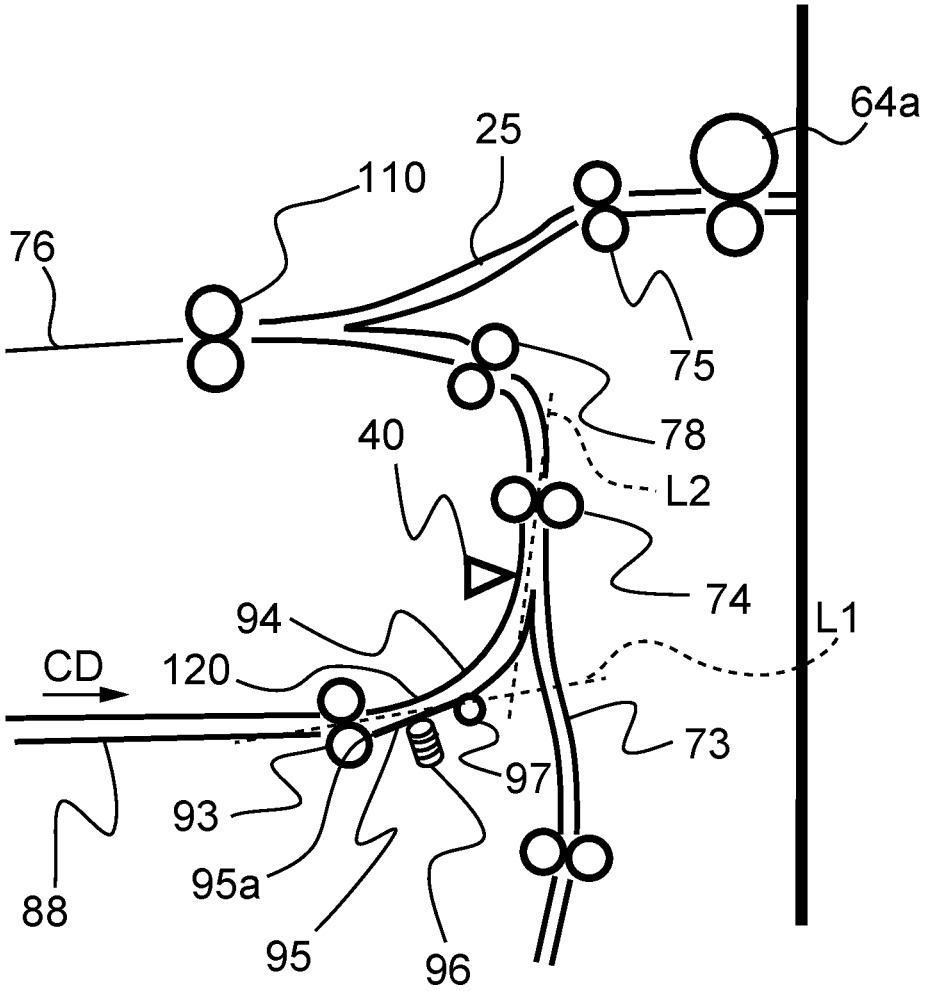
FIG. 2 is a diagram illustrating a peripheral configuration of a U-turn conveyance path.

Next, a peripheral configuration of the U-turn conveyance path 94 will be described with reference to FIGS. 1 and 2. As illustrated in FIGS. 1 and 2, the straight conveyance path 76 serving as a first conveyance path is a conveyance path that the sheet P conveyed toward the transfer nip 1E passes through. The duplex conveyance path 88 serving as a second conveyance path is a conveyance path for conveying the sheet P on a first surface of which an image has been formed in the transfer nip 1E toward the straight conveyance path 76 again. The U-turn conveyance path 94 serving as a curved conveyance path is configured to be continuous with the duplex conveyance path 88 and curved, and merge with the straight conveyance path 76.

The straight conveyance path 76 and the duplex conveyance path 88 are provided to each linearly extend in an approximately horizontal direction and be approximately parallel to each other. The U-turn conveyance path 94 is formed in an approximately U shape, and switches the advancing direction of the sheet P to an opposite direction, that is, from a rightward direction to a leftward direction in FIG. 1. In addition, the sheet P fed from the cassette 61, 62, or 63 passes through a cassette feed path 73, and the cassette feed path 73 merges with the U-turn conveyance path 94. Further, the sheet P fed from the manual feed tray 104 passes through a manual feed path 25, and the manual feed path 25 merges with a portion where the U-turn conveyance path 94 and the straight conveyance path 76 merge.

As illustrated in FIG. 2, in the printer 100, a duplex merge sensor 40, a vertical path roller pair 74, and a pre-registration roller pair 78 are provided along the U-turn conveyance path 94. The duplex merge sensor 40 detects the position of the sheet P being conveyed in the U-turn conveyance path 94. An inner guide 120 and an outer guide 95 are provided between the vertical path roller pair 74 and a conveyance roller pair 93 serving as a first roller pair that is positioned most downstream in a sheet conveyance direction CD among a plurality of conveyance roller pairs 90 to 93 arranged along the duplex conveyance path 88. To be noted, the vertical path roller pair 74 serving as a second roller pair is disposed adjacent to the conveyance roller pair 93 in the sheet conveyance direction CD. In other words, no roller pair is provided between the conveyance roller pair 93 and the vertical path roller pair 74 in the sheet conveyance direction CD. In addition, a nip line L1 of the conveyance roller pair 93 and a nip line L2 of the vertical path roller pair 74 intersect with each other.

Figure 3A:
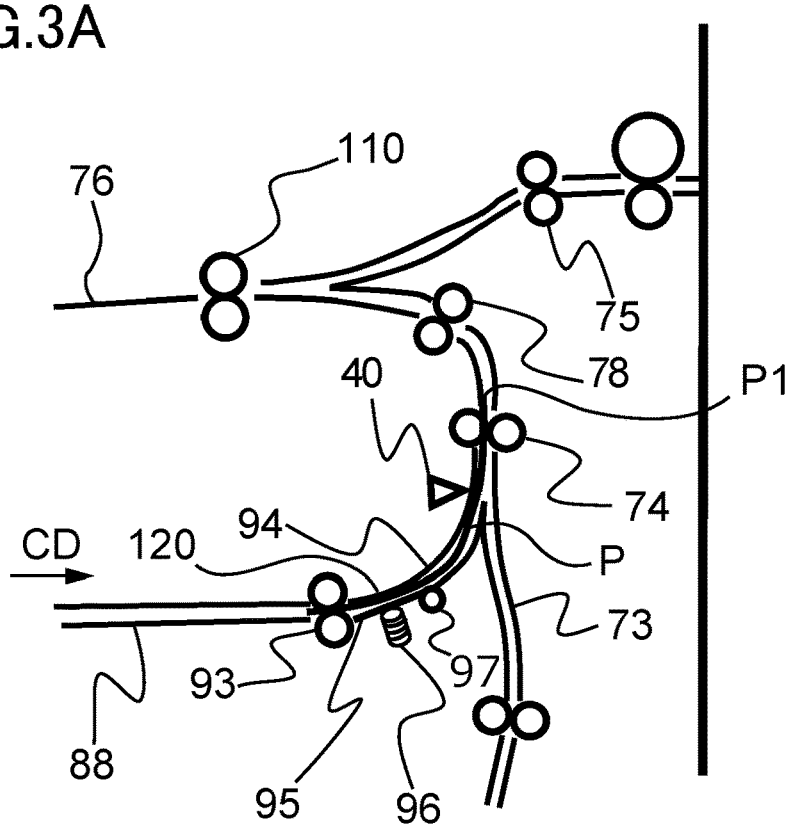
FIG. 3A is a diagram illustrating an outer guide positioned at a closed position.

The outer guide 95 opposes the inner guide 120, and constitutes part of the U-turn conveyance path 94 between the conveyance roller pair 93 and the vertical path roller pair 74 together with the inner guide 120. In addition, the outer guide 95 is provided on the outer side in a curving direction of the U-turn conveyance path 94, and is configured to be pivotable between a closed position illustrated in FIGS. 3A and 3B and an open position illustrated in FIGS. 4A and 4B about a pivot shaft 97. When the outer guide 95 is positioned at the closed position serving as a first position, an approximately uniform gap is provided between the outer guide 95 and the inner guide 120. The open position serving as a second position is farther away from the inner guide 120 than the closed position.

The outer guide 95 is urged toward the closed position by a compression spring 96 serving as an urging portion, and is positioned at the closed position by, for example, abutting an unillustrated stopper. To be noted, a spring of a different kind such as a plate spring, an elastic member such as rubber or sponge, a magnet that generates an urging force such as attraction force and repulsive force, or the like may be used instead of the compression spring 96. The pivot shaft 97 is disposed downstream of the outer guide 95 in the sheet conveyance direction CD, and an upstream end 95*a* of the outer guide 95 in the sheet conveyance direction CD is moved by pivoting the outer guide 95 between the closed position and the open position.

More specifically, in the case where the position of the upstream end 95*a* when the outer guide 95 is at the closed position is referred to as a third position and the position of the upstream end 95*a* when the outer guide 95 is at the open position is referred to as a fourth position, the fourth position is farther away from the inner guide 120 than the third position.

Operation of Outer Guide

Next, the operation of the outer guide 95 when the sheet P passes through the U-turn conveyance path 94 will be described with reference to FIGS. 3A to 4B. The sheet P passing through the duplex conveyance path 88 is conveyed toward the U-turn conveyance path 94 by the conveyance roller pair 93. Then, after a leading end P1 of the sheet P reaches the vertical path roller pair 74, the sheet P is mainly conveyed by the vertical path roller pair 74. When the sheet P passes through the U-turn conveyance path 94, the sheet P is also curved along the U-turn conveyance path 94 formed in a curved shape, and the conveyance resistance increases in accordance with the stiffness of the sheet P. Therefore, the conveyance load on the vertical path roller pair 74 that conveys the sheet P increases.

Figure 3B:
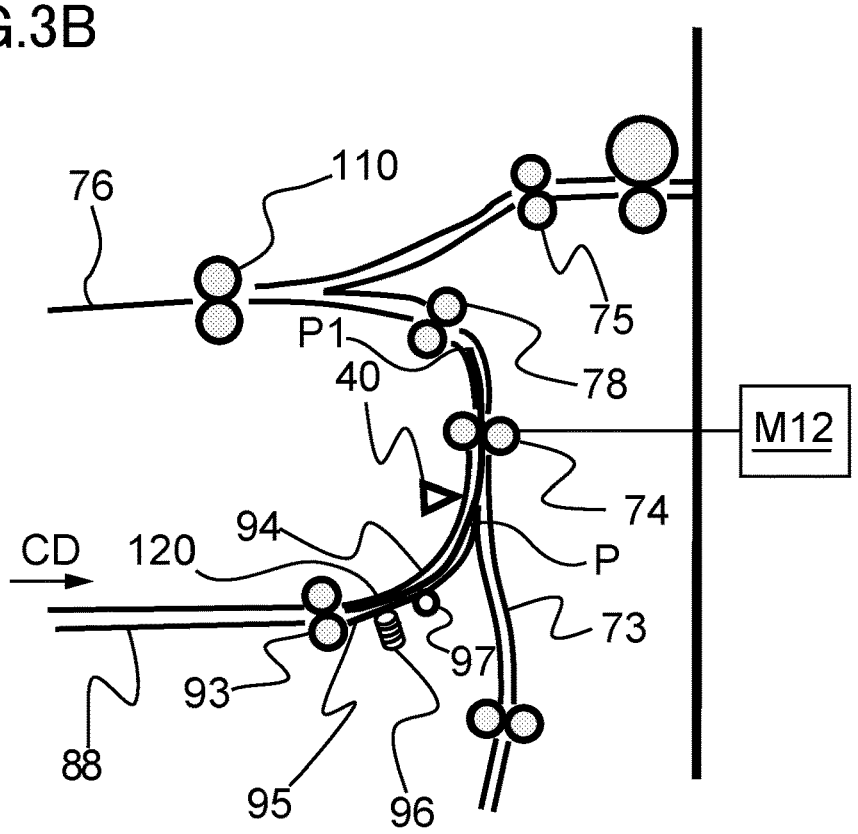
FIG. 3B is a diagram illustrating a state after the trailing end of a sheet has passed a conveyance roller pair.

As illustrated in FIG. 3B, after a trailing end P2 of the sheet P passes through the conveyance roller pair 93, the sheet P is conveyed by only the vertical path roller pair 74. When the conveyance load on the vertical path roller pair 74 exceeds a predetermined value, there is a possibility that a vertical path conveyance motor M12 serving as a drive source that drives the vertical path roller pair 74 steps out.

Figure 4A:
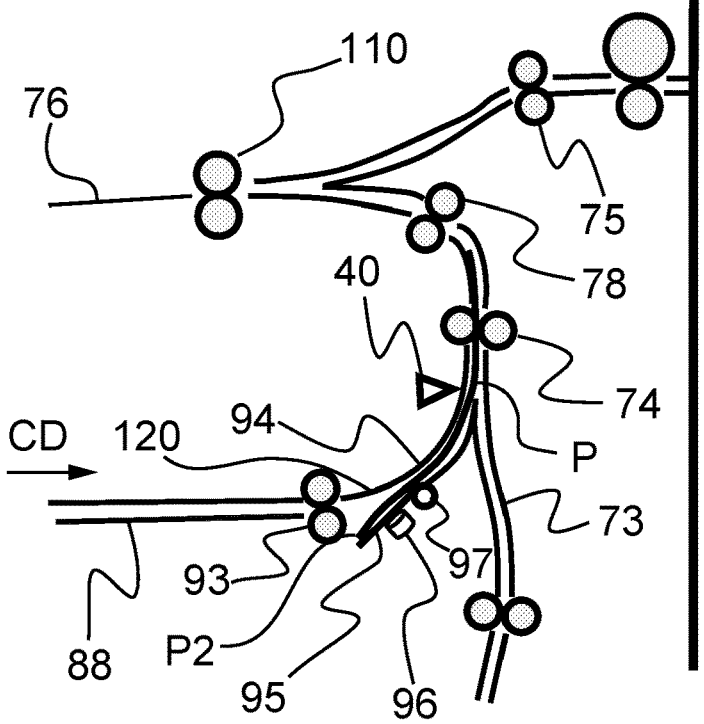
FIG. 4A is a diagram illustrating the outer guide positioned at an open position.

Therefore, in the present embodiment, the outer guide 95 constituting part of the U-turn conveyance path 94 is configured to be pivotable. When the trailing end P2 of the sheet P passes through the conveyance roller pair 93, a force to restore the sheet P curved along the U-turn conveyance path 94 to the original posture, that is, a linear posture is generated by the stiffness of the sheet P. Therefore, as illustrated in FIG. 4A, the sheet P nipped by the vertical path roller pair 74 presses the outer guide 95, and thus the outer guide 95 pivots from the closed position toward the open position about the pivot shaft 97 against the urging force of the compression spring 96.

Figure 4B:
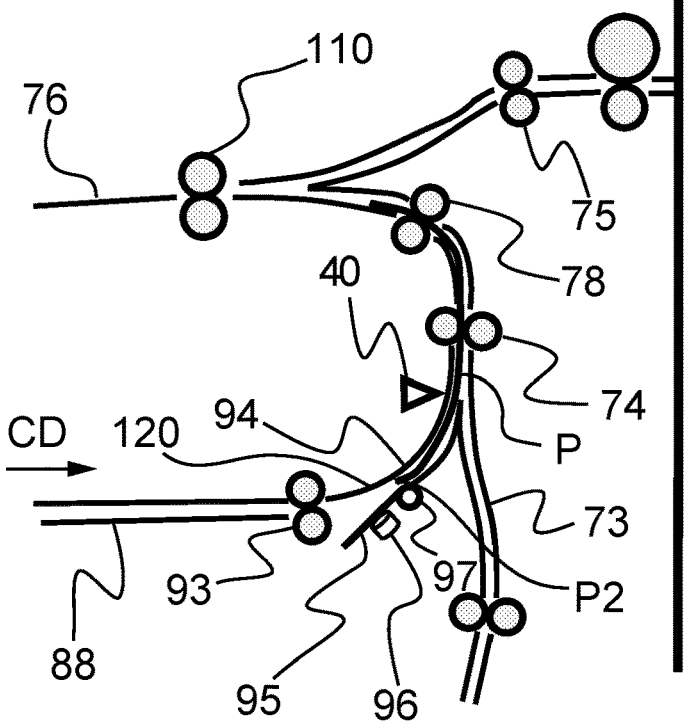
FIG. 4B is a diagram illustrating a state after the trailing end of the sheet has passed the outer guide.

As a result of this, the curved posture of the sheet P is relieved, and the force to restore the posture of the sheet P is reduced. Therefore, the conveyance load on the vertical path roller pair 74 is reduced, and occurrence of a jam caused by stepping out of the vertical path conveyance motor M12 or the like can be reduced. In addition, since the conveyance load on the vertical path roller pair 74 can be reduced without reducing the curvature of the U-turn conveyance path 94, the printer 100 can be miniaturized. As illustrated in FIG. 4B, when the trailing end P2 of the sheet P passes the outer guide 95, the outer guide 95 returns to the closed position illustrated in FIG. 3A by the urging force of the compression spring 96.

To be noted, examples of types of sheets whose conveyance load on the vertical path roller pair 74 increases in the U-turn conveyance path 94 include cardboards such as New Pigeon (350 gsm), I BEST W (360 gsm), and New DV (400 gsm). In addition, for also a sheet having a small size in a sheet conveyance direction CD such as sheets of B5 (182 mm) and A5 (148 mm) sizes, the force to restore the posture of the sheet increases due to the curved shape, and the conveyance load on the vertical path roller pair 74 increases.

Second Embodiment

Next, a second embodiment of the present invention will be described. The second embodiment is configured such that the vertical path roller pair 74 and the pre-registration roller pair 78 are driven by a single vertical path conveyance motor M2. Therefore, elements substantially the same as in the first embodiment will be denoted by the same reference signs in the drawings, or illustration thereof will be omitted.

Figure 5:
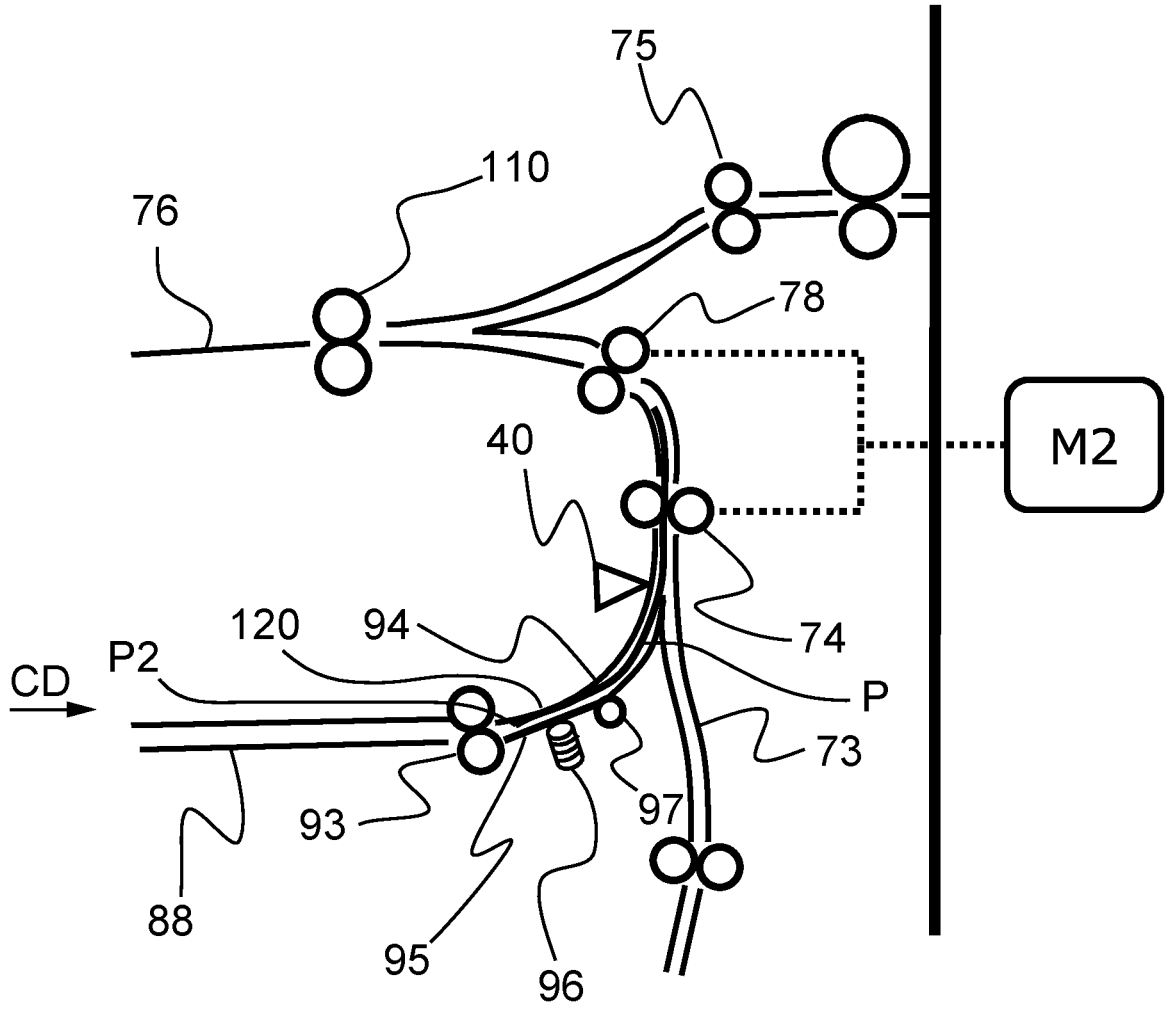
FIG. 5 is a diagram illustrating a peripheral configuration of a U-turn conveyance path according to a second embodiment.

As illustrated in FIG. 5, the printer of the present embodiment includes the pre-registration roller pair 78 disposed along the U-turn conveyance path 94 and downstream of the vertical path roller pair 74 in the sheet conveyance direction CD. The pre-registration roller pair 78 serving as a third roller pair conveys the sheet P passing through the U-turn conveyance path 94 together with the vertical path roller pair 74.

The vertical path roller pair 74 and the pre-registration roller pair 78 are driven by the vertical path conveyance motor M2 that is a single drive source. In such a configuration in which two roller pairs are driven by the single vertical path conveyance motor M2, the load is greater than in a configuration in which one roller pair such as the vertical path roller pair 74 of the first embodiment is driven by the single vertical path conveyance motor M2. Therefore, there is a higher possibility for the vertical path conveyance motor M2 to step out.

However, also in the present embodiment, the outer guide 95 is pivotable between the closed position and the open position about the pivot shaft 97 similarly to the first embodiment. Therefore, when the trailing end P2 of the sheet P passes through the conveyance roller pair 93, a force to restore the sheet P curved along the U-turn conveyance path 94 to the original posture, that is, a linear posture is generated by the stiffness of the sheet P. In this case, as illustrated in FIG. 4A, the sheet P nipped by the vertical path roller pair 74 presses the outer guide 95, and thus the outer guide 95 pivots from the closed position toward the open position about the pivot shaft 97 against the urging force of the compression spring 96.

As a result of this, the curved posture of the sheet P is relieved, and the force to restore the posture of the sheet P is reduced. Therefore, the conveyance load on the vertical path roller pair 74 and the pre-registration roller pair 78 is reduced, and occurrence of a jam caused by stepping out of the vertical path conveyance motor M2 or the like can be reduced.

Third Embodiment

Next, a third embodiment of the present invention will be described. The third embodiment is configured by adding a driving mechanism 300 for driving the outer guide 95 to the first embodiment. Therefore, elements substantially the same as in the first embodiment will be denoted by the same reference signs in the drawings, or illustration thereof will be omitted.

Figure 6:
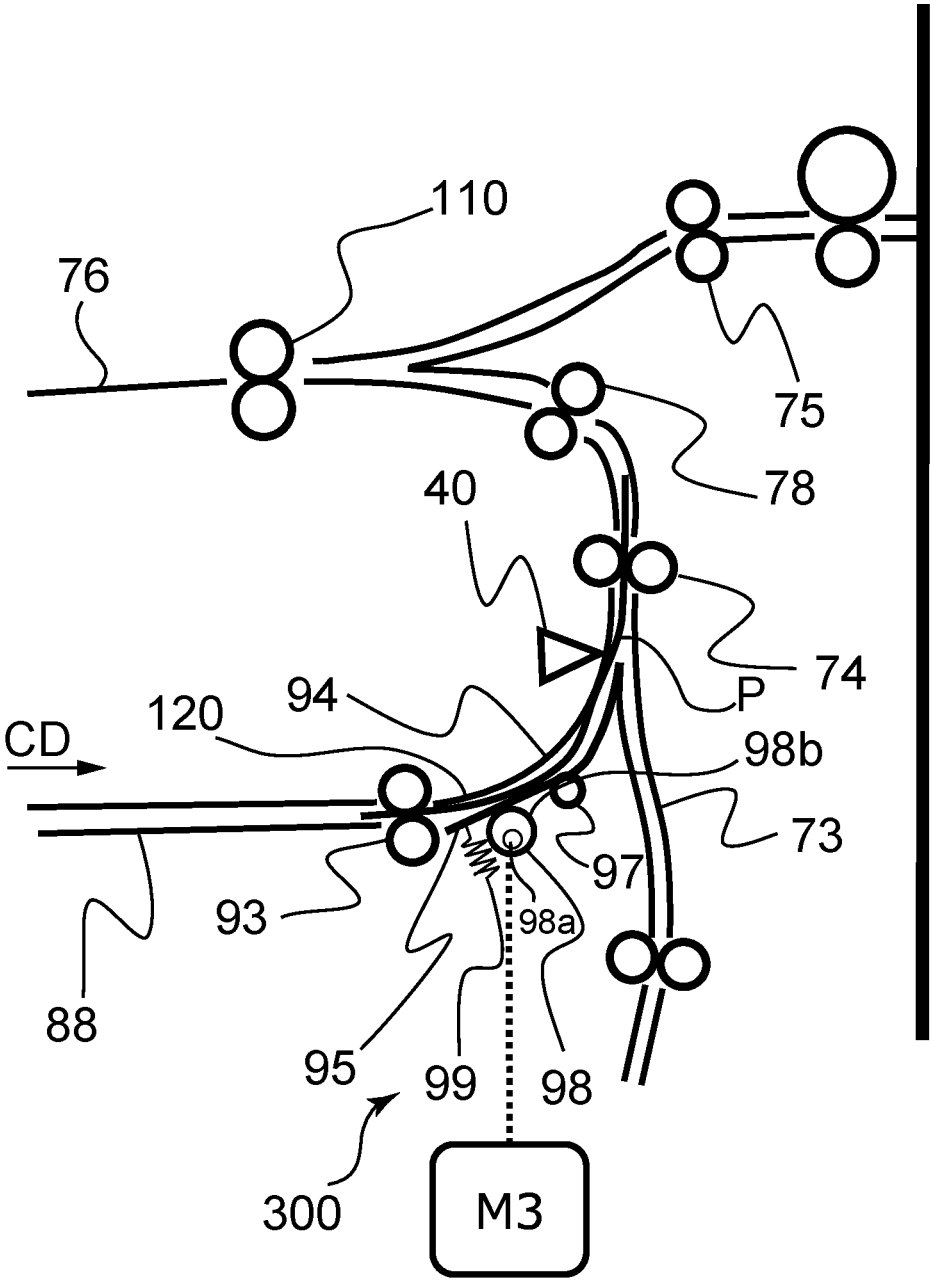
FIG. 6 is a diagram illustrating a driving configuration according to a third embodiment.

As illustrated in FIG. 6, a printer of the present embodiment includes the driving mechanism 300 for driving the outer guide 95. The driving mechanism 300 includes an eccentric cam 98 rotatable about a rotation shaft 98*a*, a tension spring 99 that urges the outer guide 95 toward an outer peripheral surface 98*b* of the eccentric cam 98, and a cam driving motor M3 that drives the eccentric cam 98.

The outer guide 95 is configured to be always in contact with the outer peripheral surface 98*b* of the eccentric cam 98 by the force of the tension spring 99. Therefore, the outer guide 95 pivots between the closed position and the open position about the pivot shaft 97 in accordance with the contact position with the eccentric cam 98.

Control Block

Figure 7:
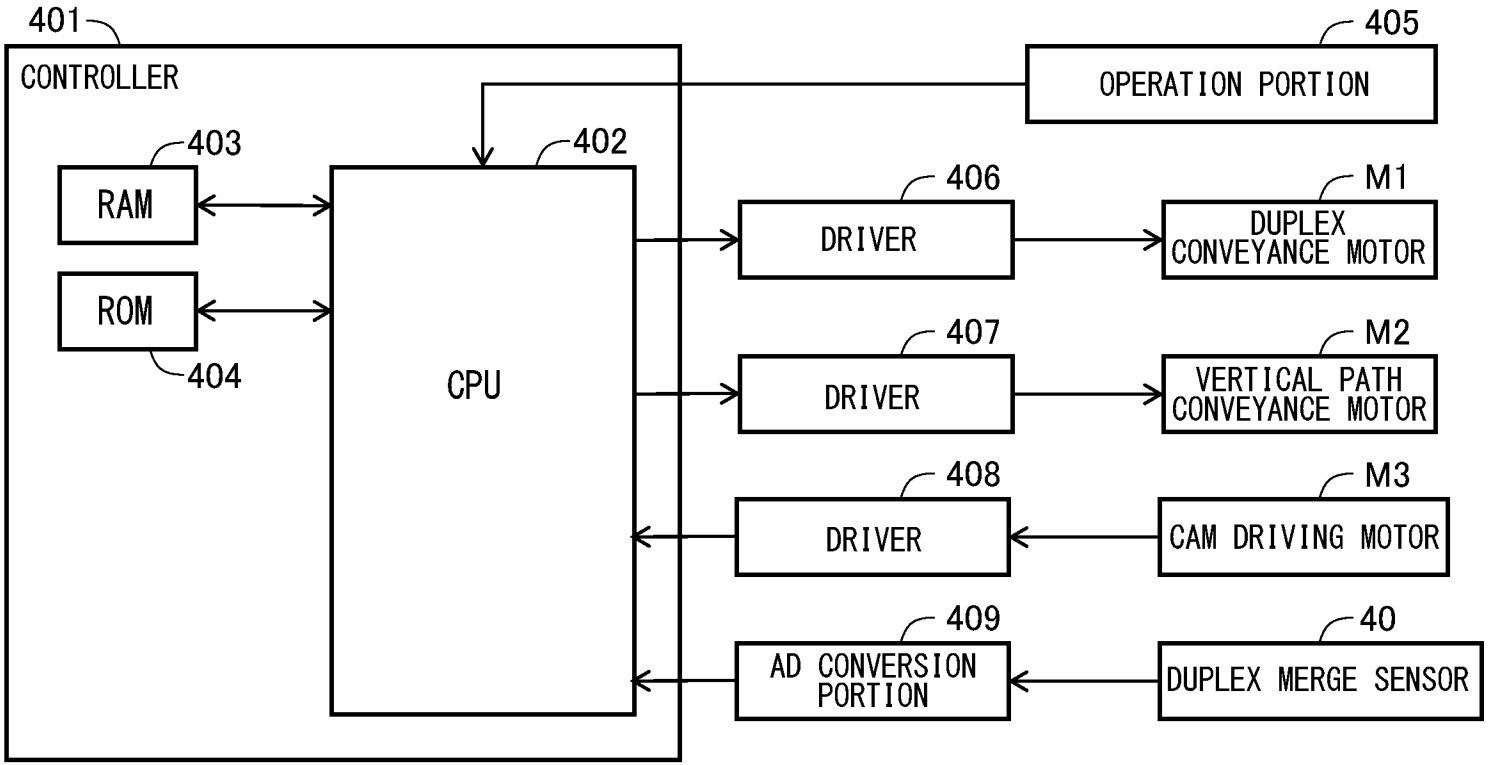
FIG. 7 is a block diagram illustrating control blocks according to the third embodiment.

FIG. 7 is a block diagram illustrating control blocks of the printer of the present embodiment. As illustrated in FIG. 7, the printer includes a controller 401. The controller 401 includes a central processing unit: CPU 402, a random access memory: RAM 403, and a read-only memory: ROM 404. The CPU 402 executes various programs stored in the ROM 404. The RAM 403 is used for a work area or the like of the CPU 402.

The CPU 402 is connected to an operation portion 405, and the user can instruct change of various settings of the printer, execution of a print job, and the like via the operation portion 405. In addition, the CPU 402 is connected to the duplex conveyance motor M1, the vertical path conveyance motor M2, and the cam driving motor M3 respectively via drivers 406, 407, and 408. The duplex conveyance motor M1 drives the conveyance roller pairs 90 to 93. The vertical path conveyance motor M2 drives the vertical path roller pair 74. The cam driving motor M3 drives the eccentric cam 98.

In addition, a signal from the duplex merge sensor 40 serving as a detection portion is input to the CPU 402 via an AD conversion portion 409. The duplex merge sensor 40 can detect the presence or absence of the sheet P at a predetermined detection position in the U-turn conveyance path 94, and thus can detect the position of the sheet P.

Operation of Outer Guide

Figure 8:
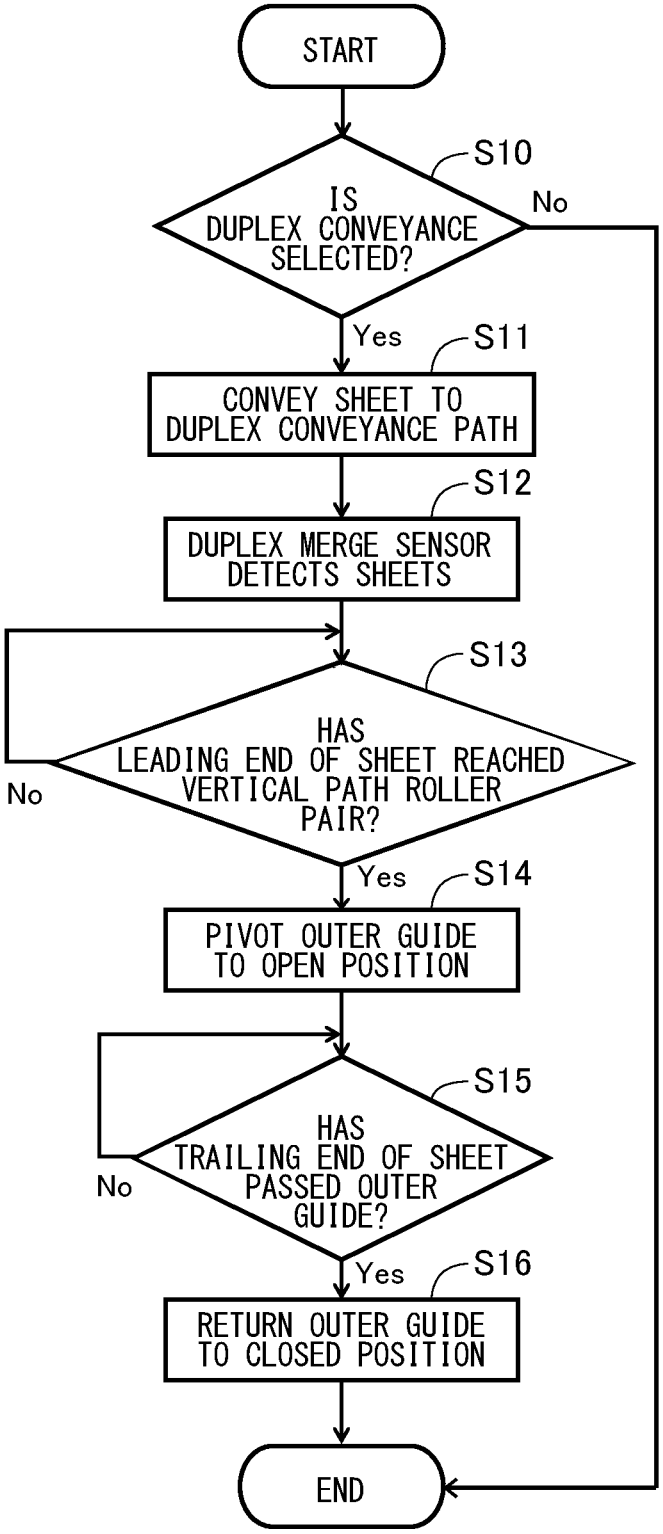
FIG. 8 is a flowchart illustrating control of a driving mechanism.

Next, the operation of the outer guide 95 will be described with reference to a flowchart of FIG. 8 and FIGS. 9A to 10B. As illustrated in FIG. 8, the CPU 402 first determines whether or not an input job is a duplex conveyance job in step S10. In the case where the input job is not a duplex conveyance job, that is, in the case where the result of step S10 is No, the process is finished.

Figure 9A:
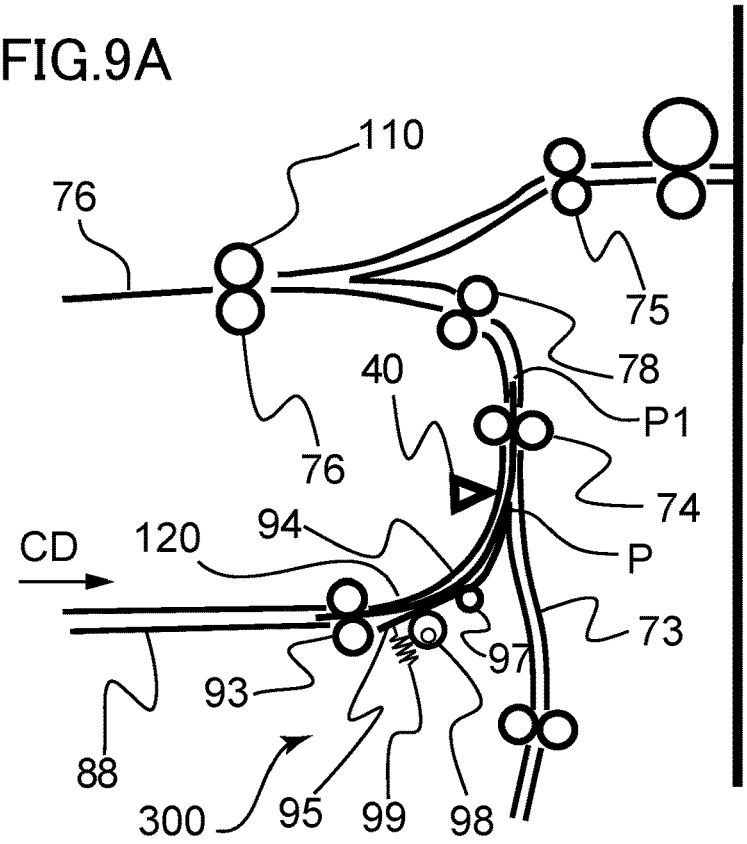
FIG. 9A is a diagram illustrating a sheet being conveyed in the U-turn conveyance path.
Figure 9B:
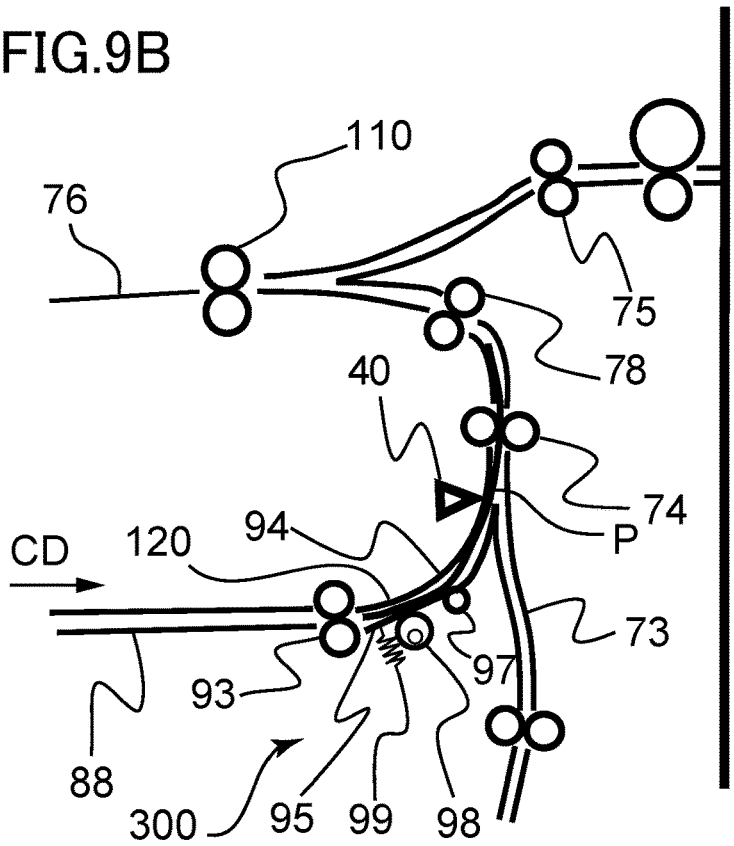
FIG. 9B is a diagram illustrating a state after the trailing end of the sheet has passed the conveyance roller pair.

In the case where the input job is a duplex conveyance job, that is, in the case where the result of step S10 is Yes, the CPU 402 controls the guide member 81, the first reverse conveyance roller pair 79, and the second reverse conveyance roller pair 86 illustrated in FIG. 1 to convey the sheet P to the duplex conveyance path 88 in step S11. Then, in step S12, the sheet P is conveyed by the conveyance roller pairs 90 to 93, and the position of the leading end P1 is detected by the duplex merge sensor 40 as illustrated in FIGS. 9A and 9B.

Figure 10A:
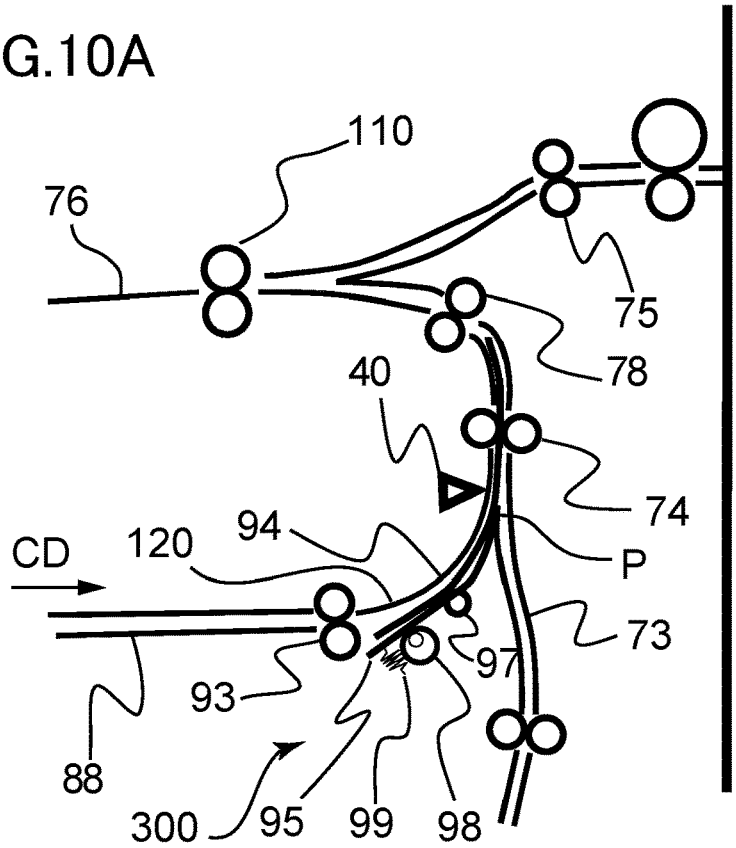
FIG. 10A is a diagram illustrating the outer guide positioned at the open position.

Next, in step S13, the CPU 402 determines, on the basis of the detection result of the duplex merge sensor 40, whether or not the leading end P1 of the sheet P has reached the vertical path roller pair 74. In the case where it has been determined that the leading end Pb has reached the vertical path roller pair 74, that is, in the case where the result of step S13 is Yes, the CPU 402 drives the eccentric cam 98 to pivot the outer guide 95 from the closed position to the open position in step S14 as illustrated in FIG. 10A.

To be noted, the timing at which the outer guide 95 pivots from the closed position to the open position is a timing after the leading end P1 of the sheet P has reached the vertical path roller pair 74 and before the trailing end P2 of the sheet P passes the outer guide 95. Preferably, the timing at which the outer guide 95 pivots from the closed position to the open position is a timing after the leading end P1 of the sheet P has reached the vertical path roller pair 74 and immediately before the trailing end P2 of the sheet P passes through the nip of the conveyance roller pair 93.

Figure 10B:
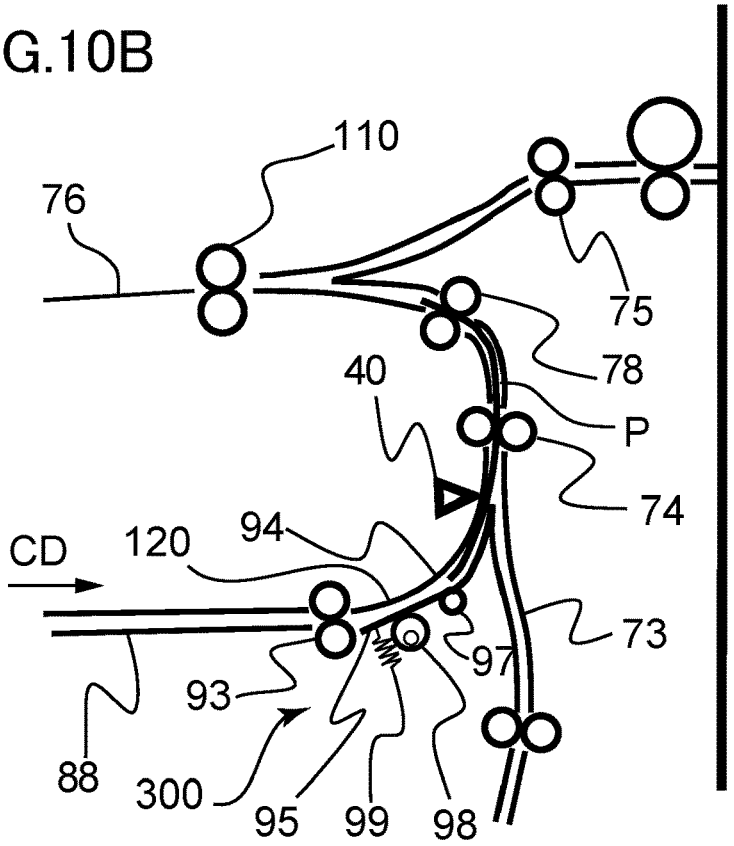
FIG. 10B is a diagram illustrating a state after the trailing end of the sheet has passed the outer guide.

Next, in step S15, the CPU 402 determines, on the basis of the detection result of the duplex merge sensor 40, whether or not the trailing end P2 of the sheet P has passed the outer guide 95. In the case where it has been determined that the trailing end P2 has passed the outer guide 95, that is, in the case where the result of step S15 is Yes, the CPU 402 drives the eccentric cam 98 to return the outer guide 95 from the open position to the closed position as illustrated in FIG. 10B. To be noted, the timing at which the outer guide 95 is returned from the open position to the closed position may be any timing as long as the timing is before the leading end of a subsequent sheet reaches the outer guide 95. As a result of this, for example, the subsequent sheet getting caught by the outer guide 95 can be suppressed, and the sheet P can be stably conveyed in the U-turn conveyance path 94.

As described above, by pivoting the outer guide 95 from the closed position to the open position by using the driving mechanism 300, the curved posture of the sheet P passing through the U-turn conveyance path 94 is relieved, and the force to restore the sheet P to the original posture is reduced.

Therefore, the conveyance load on the vertical path roller pair 74 is reduced, and a jam caused by the stepping out of the vertical path conveyance motor M2 or the like can be reduced. In addition, by pivoting the outer guide 95 by the driving mechanism 300, the outer guide 95 can be driven at an arbitrary timing regardless of the stiffness of sheets of various types and the urging force of the spring urging the outer guide 95, and thus the mechanical reliability can be improved.

To be noted, although the outer guide 95 is configured to pivot from the closed position to the open position after the leading end P1 of the sheet P has reached the vertical path roller pair 74 in the present embodiment, the configuration is not limited to this. For example, the outer guide 95 may be configured to pivot from the closed position to the open position after the leading end P1 of the sheet P has passed the outer guide 95 and before the leading end P1 reaches the vertical path roller pair 74.

OTHER EMBODIMENTS

To be noted, although the outer guide 95 is configured to be pivotable about the pivot shaft 97 in each embodiment described above, the configuration is not limited to this. For example, the outer guide 95 may be configured to be slidable from the closed position to the open position. That is, the outer guide 95 may move in any way as long as the curved posture of the sheet P conveyed in the U-turn conveyance path 94 is relieved.

In addition, although the printer 100 of the electrophotographic system has been described in each embodiment described above, the present invention is not limited to this. For example, the present invention is also applicable to an image forming apparatus of an ink jet system that forms an image on a sheet by ejecting an ink liquid from a nozzle.

In addition, the embodiments described above may be appropriately combined.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-134084, filed Aug. 19, 2021, which is hereby incorporated by reference herein in its entirety.

What is claimed is:

1. An image forming apparatus comprising:

an image forming portion configured to form an image on a sheet;

a first conveyance path through which the sheet is conveyed toward the image forming portion;

a second conveyance path through which the sheet, with an image formed by the image forming portion on a first surface thereof, is conveyed again toward the first conveyance path-se as to form an image on a second surface opposite to the first surface by the image forming portion;

a curved conveyance path that is curved and configured to be continuous with the second conveyance path and merge with the first conveyance path;

a plurality of conveying roller pairs, including a first roller pair and a second roller pair, configured to convey the sheet, wherein:

the first roller pair arranged along the second conveyance path and includes a nip portion; and the second roller pair is disposed along the curved conveyance path and is adjacent to the first roller pair in a sheet conveyance direction;

an inner guide; and an outer guide opposing the inner guide, constituting at least part of the curved conveyance path between the first roller pair and the second roller pair together with the inner guide, and provided on an outer side in a curving direction of the curved conveyance path, wherein the outer guide is:

movable between a first position and a second position that is farther away from the inner guide than the first position; and held in the first position until a trailing end of the sheet conveyed by the second roller pair passes through the nip portion of the first roller pair; and an urging portion configured to urge the outer guide toward the first portion, wherein a nip line of the first roller pair and a nip line of the second roller pair intersect with each other, and wherein the outer guide moves from the first position toward the second position against an urging force of the urging portion by being pressed by the trailing end of the sheet conveyed by the second roller pair in a state where the trailing end of the street conveyed by the second roller pair has passed through the first roller pair.

2. The image forming apparatus according to claim 1, wherein;

the outer guide is pivotable between the first position and the second position about a pivot shaft, and an upstream end of the outer guide in the sheet conveyance direction is positioned at:

a third position in a state where the outer guide is positioned at the first position; and a fourth position farther away from the inner guide than the third position in a state where the outer guide is positioned at the second position.

3. The image forming apparatus according to claim 1, wherein the outer guide is provided adjacent to the first roller pair in the sheet conveyance direction.

4. The image forming apparatus according to claim 1, further comprising:

a drive source, wherein the plurality of conveying roller pairs further include a third roller pair disposed along the curved conveyance path and downstream of the second roller pair in the sheet conveyance direction, and wherein the drive source is configured to drive the second roller pair and the third roller pair.

5. The image forming apparatus according to claim 1, wherein;

the first conveyance path and the second conveyance path are arranged approximately parallel to each other, and the curved conveyance path is provided in a U shape.

6. The image forming apparatus according to claim 1, wherein the outer guide maintains in the second position until the trailing end of the sheet conveyed by the second roller pair passes through the outer guide after moving to the second position.

7. The image forming apparatus according to claim 1, the second roller pair conveys the sheet while the outer guide is moving from the first position toward the second position.

8. The image forming apparatus according to claim 1, the outer guide moves from the second position toward the first position by the urging force of the urging portion after the trailing end of the sheet conveyed by the second roller pair passes through the outer guide.

9. The image forming apparatus according to claim 2, the pivot shaft is positioned in a downstream end portion, in the sheet conveyance direction, of the outer guide.

10. The image forming apparatus according to claim 1, wherein the second roller pair is positioned downstream of the first roller pair in the sheet conveyance direction.

* * * * *